US007077706B1

(12) United States Patent
Yang

(10) Patent No.: US 7,077,706 B1
(45) Date of Patent: Jul. 18, 2006

(54) COVER FOR TERMINAL SCREWS OF A RECEPTACLE

(75) Inventor: Wen Ho Yang, Taipei County (TW)

(73) Assignee: Sun-Lite Sockets Industry Inc., Taoyuan (TW)

( * ) Notice: Subject to any disclaimer, the term of this patent is extended or adjusted under 35 U.S.C. 154(b) by 0 days.

(21) Appl. No.: 11/207,835

(22) Filed: Aug. 22, 2005

(51) Int. Cl.
*H01R 31/00* (2006.01)

(52) U.S. Cl. ..... 439/650; 439/136; 174/66

(58) Field of Classification Search ..... 174/66, 174/67; 439/650, 136, 135
See application file for complete search history.

(56) References Cited

U.S. PATENT DOCUMENTS 3,140,344 A * 7/1964 Slater et al. ..... 439/142
5,389,740 A * 2/1995 Austin ..... 439/144
5,675,126 A * 10/1997 Halvorsen ..... 174/67
5,998,734 A * 12/1999 Kerestan et al. ..... 439/650
6,417,450 B1 * 7/2002 Young ..... 174/66
6,552,262 B1 * 4/2003 English et al. ..... 174/66

* cited by examiner

*Primary Examiner*—Briggitte R. Hammond

(57) ABSTRACT

A cover for terminal screws of a receptacle, which has plug holes with a positive and a negative pole connected with terminal screws with a power line, is composed of a pivotal column, a locking hook and a cover case. The pivotal column is fixed on a sidewall of the receptacle, having a pivotal pin on its top and its bottom. The locking hook is fixed on the other side of the pivotal column on the sidewall. The cover case has a flat projection on the top and the bottom of its inner side, with each flat projection bored with a locking hole, and a locking bar with a rear opening provided at its other side. Then the pivotal pins may insert in the pivotal holes of the flat projections, and the locking bar is to lock with the locking hook, which is then to be confined in the opening, enabling the cover case to close stably on the terminal screws.

6 Claims, 4 Drawing Sheets

COVER FOR TERMINAL SCREWS OF A RECEPTACLE

BACKGROUND OF THE INVENTION

1. Field of the Invention

This invention relates to a cover for terminal screws of a receptacle, particularly to one combined on a sidewall of a receptacle where terminal screws to be connected with a power line is located, and able to cover on the terminal screws to keep them from being contacted with other objects for preventing any accident like short-circuits or sparking.

2. Description of the Prior Art

A common conventional receptacle 10, as shown in FIGS. 1 and 2, is provided with plug holes 11 set on its front surface. Each of the plugholes 11 is connected through each other by a positive line and a negative line respectively inside the receptacle 10. Then, the positive line and the negative line are pulled out from one sidewall of the receptacle 10 and connected by terminal screws 12 with input and output currents of the power line 13. In installation, the power line 13 is first connected with the receptacle 10 with the terminal screws 12 exposed without any protection as shown in FIG. 1, then the receptacle 10 is put into a fixing box and screwed from two fixing holes 14 at the top and the end of the receptacle 10 respectively to fix with the fixing box. Usually, the conventional receptacle 10 has a higher rating (15 A 125V). Therefore, in order to gain enough strength in practice, the fixing box for fixing with the receptacle 10 is mainly made of metallic materials. Because the terminal screws 12 are always exposed without any protection, they are very apt to contact with the fixing box or other exterior objects when the receptacle 10 is put into or taken away from the fixing box, causing short-circuit or sparking. Though such an accident does not absolutely take place, it would be a very serious event if it happens. Therefore, in order to improve such a defect in the conventional, the inventor has been made with effort to offer a cover for terminal screws of a receptacle in the present invention.

SUMMARY OF THE INVENTION

The prime object of this invention is to offer a cover to cover on terminal screws of a receptacle to prevent them from being contacted with other objects and from subsequent short-circuiting or sparking.

The main characteristic of the invention is a cover covering on terminal screws of a receptacle, which has plug holes in its upper surface and a positive and a negative poles fixed in the plug holes and extending to two holes in a sidewall of the receptacle and then connected with a power line with terminal screws in the same sidewall. The cover is composed of a pivotal column, a locking hook and a cover case. The pivotal column is formed on one side of the sidewall of the receptacle where the terminal screws are located, having a pivotal pin on its top and its bottom respectively. The locking hook is formed on the other side of the sidewalls opposite to the terminal screws. The cover case, shaped recessed, is provided with a flat projection respectively at the top and the bottom of its inner side, with the flat projections respectively cut with a pivot hole. The cover case also possesses a locking bar at its outer side with an opening formed in its rear side. Coordinately, the pivot holes of the flat projections are to be inserted by the pivotal pins and the locking bar is to lock with the locking hook, which is then to be confined in the opening, enabling the cover case to cover on the terminal screws.

One feature of the cover case is a slope provided to taper outward on the upper surface of each pivotal pin, and the flat projections of the cover case are respectively provided with an inclined surface. In combining, the inclined surface of the locking projection may fit with the slope of the pivotal pin, and the flat projections may slide relative to the pivot pin owing to mutual fitting of the slope and the inclined surface, letting the pivotal pins fit in the pivot holes to function as pivots.

Another feature of the cover is the locking hook provided with a slope on its outer surface, and a hooking part formed in its front side, so when the cover case closes, the locking bar first reaches the slope of the locking hook and forces the locking hook to retreat a bit, and then slides and passes the slope to lock with the locking hook.

Another feature of the cover case is a blocker provided behind the opening of the locking bar, and the locking hook is provided with an L-shaped groove behind the slope. Then when the locking bar locks with the hooking part, the blocker may fit in the L-shaped groove, helping to push against the locking hook to ensure mutual locking of the locking hook with the locking bar.

Another feature of the cover case is the blocker provided with an inward-rising slope in the front wall, in order not to obstruct the locking hook to move inward.

One more feature of the cover case is recessed groove provided in the bottom edge for the power line to pass through in case of the cover case closed.

BRIEF DESCRIPTION OF DRAWINGS

This invention is better understood by referring to the accompanying drawings, wherein.

DETAILED DESCRIPTION OF THE PREFERRED EMBODIMENT

Figure 1:
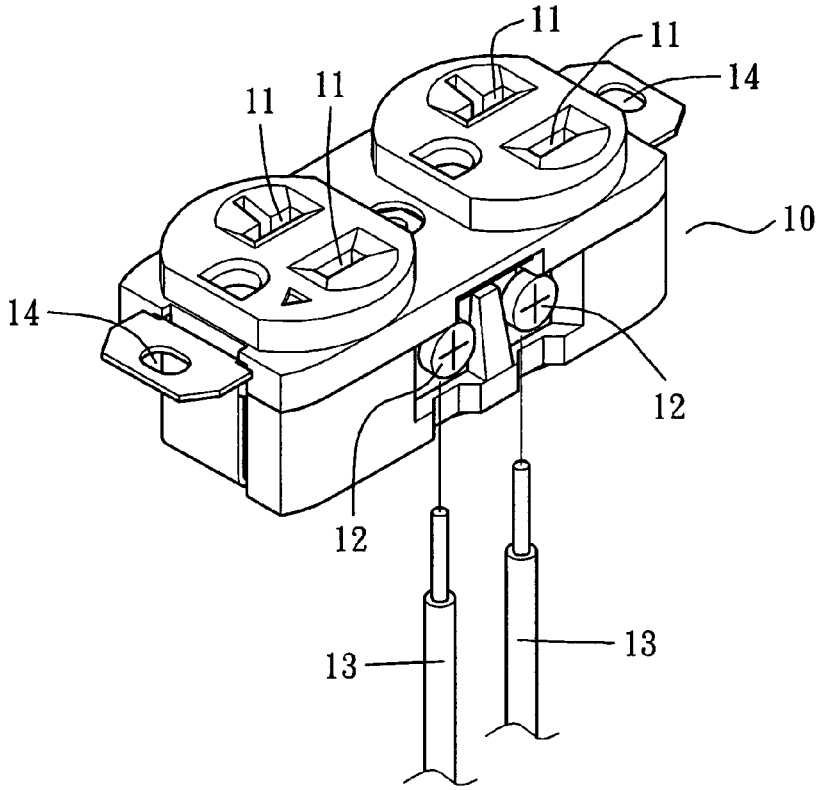
FIG. 1 (PRIOR ART)
FIG. 1 is an exploded perspective view of a conventional receptacle, including a power line.
Figure 2:
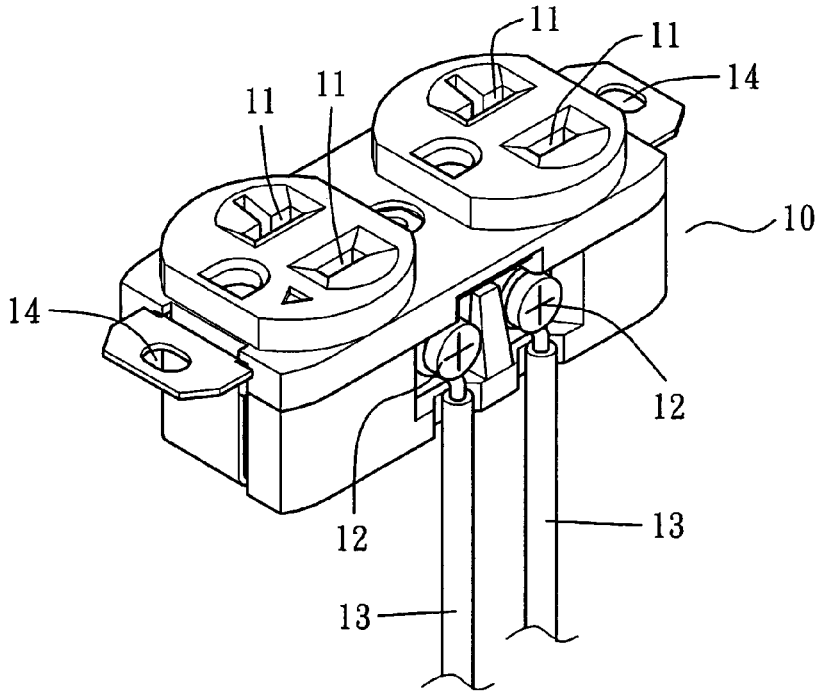
FIG. 2 (PRIOR ART)
FIG. 2 is a perspective view of a conventional receptacle, including a power line.
Figure 3:
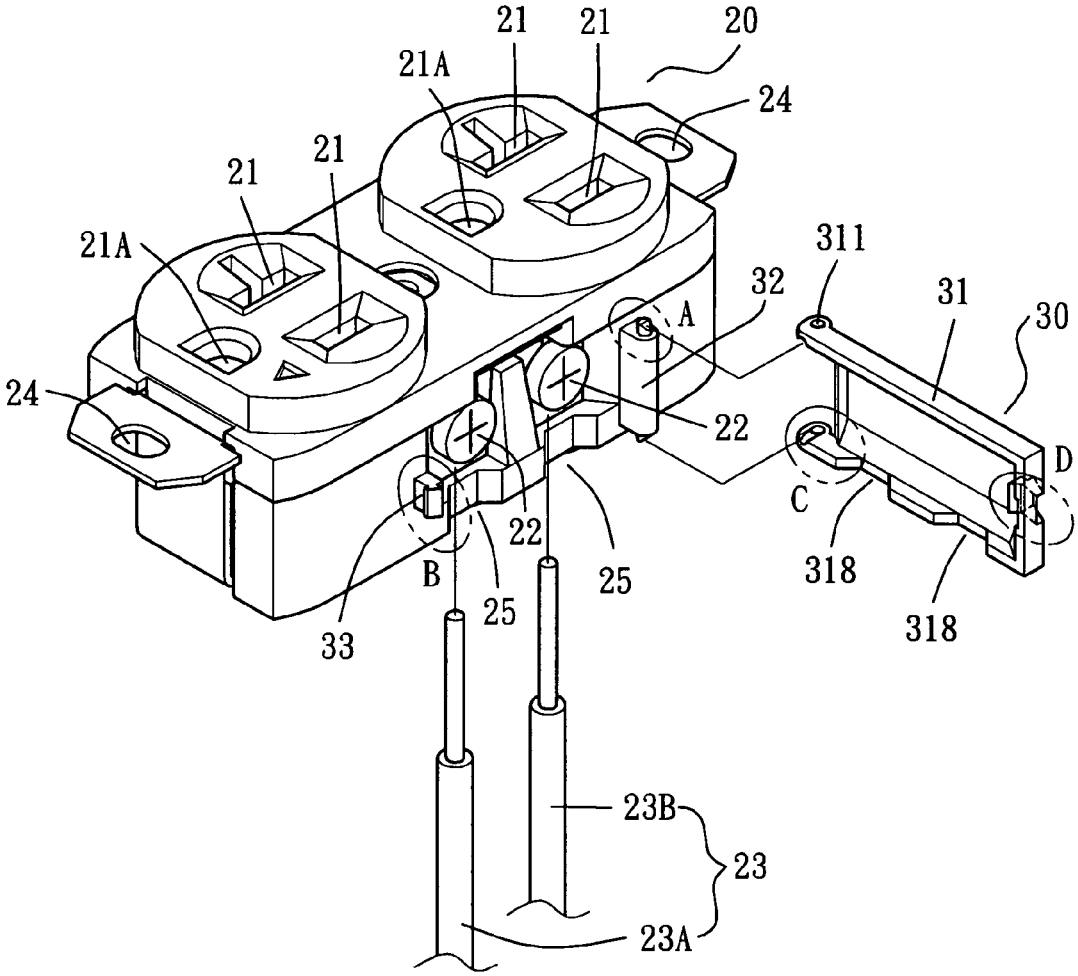
FIG. 3 is an exploded view of a preferred embodiment of a cover for terminal screws of a receptacle in the present invention.

FIG. 3 shows a preferred embodiment of a cover 30 for terminal screws of a receptacle in the present invention, and the receptacle includes a receptacle 20 and the cover 30.

The receptacle 20 is provided with plural sets of plughole 21 in an upper surface to be inserted by the feet of a plug. A third plughole 21A is to be inserted by the third foot of a plug, if the plug has it, for grounding. Each hole of the plughole 21 is respectively fixed with a positive pole or a negative pole extending to holes in a sidewall of the receptacle 20, connected with terminal screws 22 with power lines 23. A power line 23A for an input and the other power line 23B is for an output to be connected to another utility, if necessary. In other words, the power line 23 can be one or two with the one 23A being necessary and the other 23B being optional. At the bottom edge of the receptacle 20 where the power lines 23 passes is formed with a recessed groove 25 to let the power lines 23 pass through easily. The receptacle 20, after connected with the two power lines 23; is able to be inserted and fixed into a fixing box by screwing from two fixing holes 24 bored respectively at two ends of the receptacle 20. Before fixing into the fixing box, the cover 30 in this invention is specially provided to cover up the terminal screws 22 to prevent them from being touched for safety concern and becomes the main characteristic of the present invention.

Figure 4:
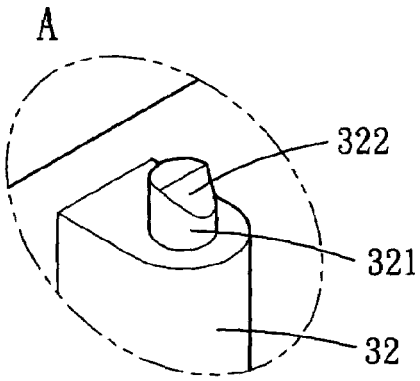
FIG. 4 is a magnified view of the part marked (A) in FIG. 3.
Figure 5:
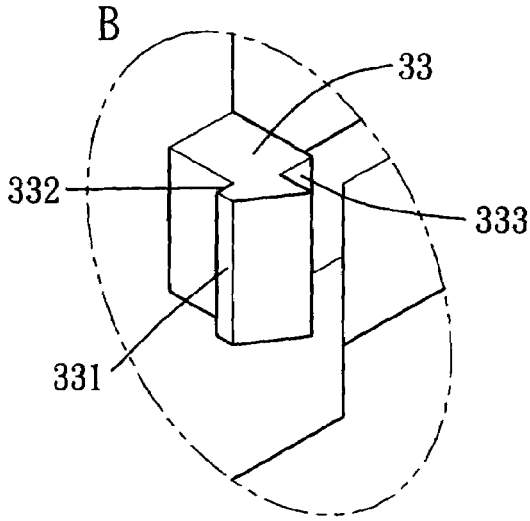
FIG. 5 is a magnified view of the part marked (B) in FIG. 3.
Figure 6:
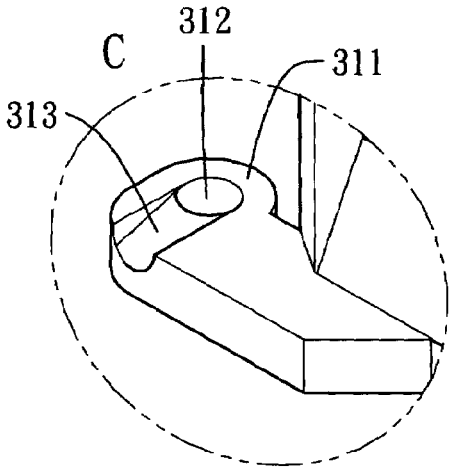
FIG. 6 is a magnified view of the part marked (C) in FIG. 3.
Figure 7:
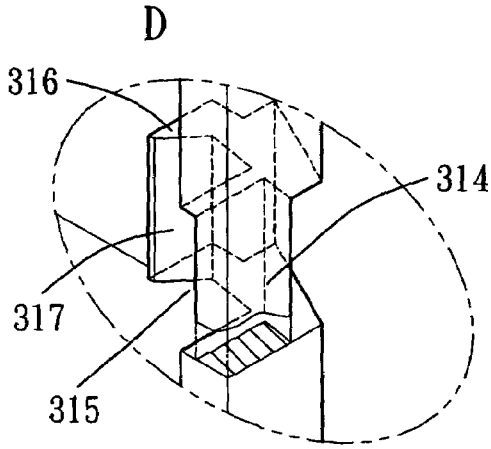
FIG. 7 is a magnified view of the part marked (D) in FIG. 3.

The cover 30 is composed of a cover case 31, a pivotal column 32 and a locking hook 33. As shown in FIG. 3, in one sidewall where the terminal screws 22 are located is formed with the pivotal column 32 having two pivotal pins 321 at its top and its bottom. Each of the pivotal pins 321, as shown in FIG. 4, is provided with a slope 322 on its top. At the other side of the pivotal column 22 on the same sidewall is provided with the locking hook 33, which, as shown in FIG. 5, possesses a vertical slope 331 at its outer surface, a hooking part 332 at its front end, and an L-shaped groove 333 in the rear side. The cover case 31 is shaped to have a recessed space. The inner side of the cover case 31 to match with the pivotal column 32 has a flat projection 311 on its top and its bottom respectively, and, as shown in FIG. 6, each flat projection 311 has a pivot hole 312 and an inclined surface 313 at the side facing the interior of the cover case 31. And, the outer side of the cover case 31 to be locked with the locking hook 33 is formed with a locking bar 314, which, as shown in FIG. 7, has an opening 315 in the rear side. Inside the opening 315 is set with a blocker 316 provided with an inward-rising slope 317 at its front wall. Furthermore, the bottom edge of the cover case 31 has two recessed grooves 318 to match with the recessed grooves 25 respectively to form spaces for the power line 23 to pass through.

In assembling, pick the cover case 31 first and move it near to the terminal screws 22 with its interior ahead, then let the two inclined surfaces 313 of the flat projection 311 touch the two slopes 322 on the pivotal pins 321 respectively and push forwards slightly the cover case 31 along the inclined surfaces 313. While pushing the cover case 31 along the inclined surfaces 313, the flat projections 311 are slightly shifted to slide over the pivotal pins 321 as the pivotal pins 321 are guided by the inclined surfaces 313 to the pivot holes 312, and the flat projections 311 rebound back after passing over the pivotal pins 321, making the pivot holes 312 receive the pivotal pins 321 so that the pivotal pins 321 are engaged in the pivot holes 312. So, the cover case 31 is able to pivot by the pivotal pins 321. When the cover case 31, after it is combined with the receptacle 20, is swung inward to approach the locking hook 33, the inner edge of the locking bar 314 on it will first touch the slope 331 of the locking hook 33. Next, increased force will force the locking hook 33 to squeeze inwards slightly and the locking bar 314 to be shifted outwards slightly to pass over the slope 331. Then, the locking bar 314 and the locking hook 33 rebound back to their normal positions after the locking bar 314 has passed over the slope 331, locking with the hooking part 332 of the locking hook 33. By the time, the slope 331 of the locking hook 33 is confined in the opening 315 of the locking bar 314, and the blocker 316 of the cover case 31 is to naturally lock with the L-shaped groove 333 of the locking hook 33, supporting the locking hook 33 from its back, keeping the hooking part 332 and the locking bar 314 be locked each other tightly without possibility of disconnection. And, the inward-rising slope 317 is shaped in the front of the blocker 316, the action of the blocker 316 sliding into the L-shaped groove 333 does not interfere with the action of the locking hook 33 squeezed inwards slightly, making the whole action of closing the cover case 31 carried out smoothly.

Figure 8:
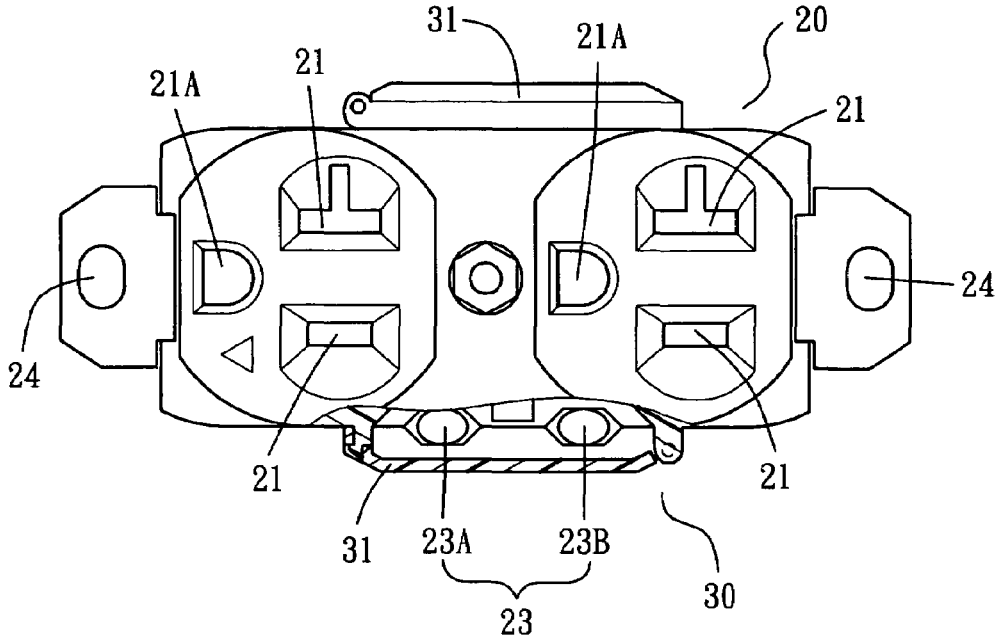
FIG. 8 is a front view of the preferred embodiment of the cover for terminal screws of a receptacle in the present invention.
Figure 9:
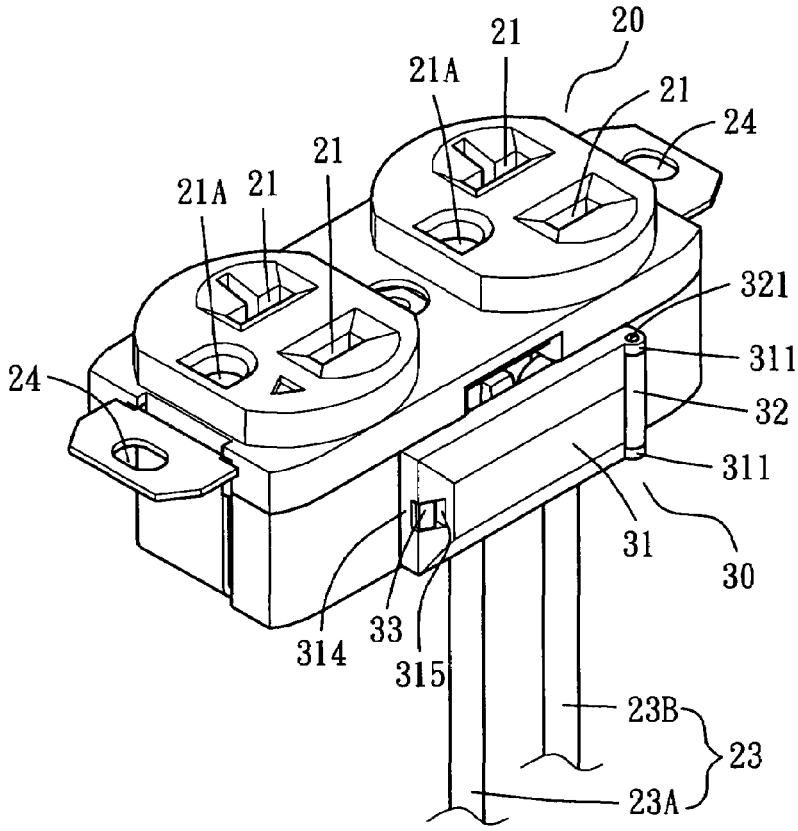
FIG. 9 is a perspective view of the preferred embodiment of a cover in the present invention, showing it being assembled and ready for use.

In using, as shown in FIGS. 8 and 9, the terminal screws 22 covered by the cover case 31 can not be touched by the fixing box or any exterior matters while the receptacle 20 is inserted into or taken away from the fixing box, revving up safety greatly.

While the preferred embodiment of the invention has been described above, it will be recognized and understood that various modifications may be made therein and the appended claims are intended to cover all such modifications that may fall within the spirit and scope of the invention.

What is claimed is:

1. A cover for terminal screws of a receptacle, said receptacle comprising:

plural sets of plug holes in an upper surface for a plug's feet to insert, said plug holes respectively connected with a positive pole and a negative pole extending to holes in one side wall of said receptacle, said positive and negative poles adapted for connection by terminal screws with a power line;

said cover comprising a pivotal column, a locking hook and a cover case;

said pivotal column formed on one side of said sidewall of said receptacle where said terminal screws are located, said pivotal column having a pivotal pin on top and bottom ends of the pivotal column respectively;

said locking hook formed on the other side of said sidewall where said terminal screws are located; and, said cover case being recessed and having a flat projection respectively on top and bottom edges of an inner side of the cover case, a locking bar formed at an outer side of the cover case and an opening provided in a rear side of the locking bar; said flat projections further having a pivot hole for each said pivotal pin to insert; said locking bar locking coordinately with said locking hook whereby said terminal screws are kept covered by said cover case.

2. the cover for terminal screws of a receptacle as claimed in claim 1, wherein ends of said pivotal pins respectively possess a slope facing outwards and said flat projections respectively of said pivotal column have an inclined surface facing an interior wall of said receptacle; said inclined surfaces of said flat projections are configured to guide said pivotal pins to engage in said pivot holes whereby said cover case is pivotally engaged to said pivotal column.

3. The cover for terminal screws of a receptacle as claimed in claim 1, wherein a front side of said locking hook is provided with a slope, and a front end of said locking hook is provided with a hooking part at its front end, whereby when said cover case is to be closed up, said locking bar is to be made to rest on said slope of said locking hook, which is then to be squeezed to shift inwards slightly to let said locking bar to pass over said slope and to lock with said hooking part.

4. The cover for terminal screws of a receptacle as claimed in claim 1, wherein a blocker is provided inside said cover case at the inner side of said opening, an L-shaped groove is formed at the inner side of said locking hook in the rear side of said slope, said locking bar is locked with said hooking part of said locking hook, and said blocker is to be locked in said L-shaped groove to support said locking hook, keeping said hooking part be locked effectively with said locking bar.

5. The cover for terminal screws of a receptacle as claimed in claim 4, wherein a front wall of said blocker is provided with an inward-rising slope.

6. The cover for terminal screws of a receptacle as claimed in claim 1, wherein the bottom edge of said cover case further has plural recessed grooves, enabling said power line to pass therethrough easily.

* * * * *